US008936429B2

(12) United States Patent
Gaully et al.

(10) Patent No.: US 8,936,429 B2
(45) Date of Patent: Jan. 20, 2015

(54) CONTROL UNIT AND A METHOD FOR CONTROLLING BLADE TIP CLEARANCE

(75) Inventors: Bruno Robert Gaully, Marolles en Hurepoix (FR); Cedrik Djelassi, Marolles en Hurepoix (FR); Cecile Marot, Ploemeur (FR)

(73) Assignee: SNECMA, Paris (FR)

( * ) Notice: Subject to any disclaimer, the term of this patent is extended or adjusted under 35 U.S.C. 154(b) by 554 days.

(21) Appl. No.: 13/363,763

(22) Filed: Feb. 1, 2012

(65) Prior Publication Data

US 2012/0201651 A1 Aug. 9, 2012

(30) Foreign Application Priority Data

Feb. 8, 2011 (FR) ..... 11 51002

(51) Int. Cl.
*F01D 11/24* (2006.01)

(52) U.S. Cl.
CPC ..... *F01D 11/24* (2013.01)
USPC ..... 415/1

(58) Field of Classification Search
CPC ..... F01D 11/24; F01D 11/08; F01D 11/20; F01D 25/08; F01D 11/18; F01D 25/12; F01D 25/14
USPC ..... 415/115, 116, 1, 178, 173.2, 175, 47, 415/173.1, 174.1
See application file for complete search history.

(56) References Cited

U.S. PATENT DOCUMENTS 4,844,688 A * 7/1989 Clough et al. ..... 415/116
4,849,895 A 7/1989 Kervistin
5,048,288 A * 9/1991 Bessette et al. ..... 60/226.1
2001/0023581 A1 9/2001 Ojiro et al.
2004/0018084 A1 * 1/2004 Halliwell et al. ..... 415/173.1
2005/0109016 A1 5/2005 Ullyott
2005/0276690 A1 12/2005 Amiot et al.

(Continued)

FOREIGN PATENT DOCUMENTS

EP 0 288 356 A1 10/1988
EP 1 132 577 A2 9/2001

(Continued)

OTHER PUBLICATIONS

French Preliminary Search Report issued Sep. 29, 2011, in French 1151002, filed Feb. 8, 2011 (with English Translation of Categories of Cited Documents).

*Primary Examiner* — Nathaniel Wiehe
*Assistant Examiner* — Eldon Brockman
(74) *Attorney, Agent, or Firm* — Oblon, Spivak, McClelland, Maier & Neustadt, L.L.P.

(57) ABSTRACT

A method and system for controlling clearance between the tips of blades of a turbine rotor in a gas turbine airplane engine and a turbine ring of a casing surrounding the blades. A valve is controlled to act on a flow rate and/or a temperature of air directed against the casing. The valve is of the on/off type for switching between an open state and a closed state in a determined reaction time, the valve control module including a corrector for determining a first binary control signal that can take a first value corresponding to an open state and a second value corresponding to a closed state of the valve. The corrector includes a time-delay module for determining a binary control signal, with the duration between two successive changes of state in the control signal being not less than the reaction time of the valve.

5 Claims, 3 Drawing Sheets

(56) References Cited

U.S. PATENT DOCUMENTS

| | | | | |
|---|---|---|---|---|
| 2008/0063509 | A1* | 3/2008 | Sutherland et al. | 415/14 |
| 2011/0027068 | A1 | 2/2011 | Floyd, II et al. | |

FOREIGN PATENT DOCUMENTS

| | | |
|---|---|---|
| EP | 1 607 584 A1 | 12/2005 |
| GB | 1 581 855 | 12/1980 |

* cited by examiner

CONTROL UNIT AND A METHOD FOR CONTROLLING BLADE TIP CLEARANCE

BACKGROUND OF THE INVENTION

The present invention relates to the general field of turbomachinery for gas turbine aeroengines. It relates more particularly to controlling the clearance between the tips of moving blades of a turbine rotor and a turbine ring of an outlet casing surrounding the blades.

The clearance that exists between the tips of the blades of the turbine and the ring that surrounds them depends on differences between the variations in the dimensions of the rotary portions (disk and blades forming the turbine rotor) and of the stationary portions (outer casing and the turbine ring that it includes). These variations in dimensions are both of thermal origin (associated with variations in the temperature of the blades, of the disk, and of the casing) and also of mechanical origin (in particular associated with the effect of the centrifugal force that acts on the turbine rotor).

In order to increase the performance of a turbine, it is desirable to minimize the clearance so that it is as small as possible. Furthermore, while engine speed is increasing, e.g. on going from an idling speed on the ground to a take-off speed in an aeroengine gas turbine, the centrifugal force acting on the turbine rotor tends to move the tips of the blades towards the turbine ring before the turbine ring has had the time to expand under the effect of the increase in temperature associated with the increase in speed. There is thus a risk of contact at this point of operation, which point is referred to as the pinch point.

It is known to have recourse to a system for actively controlling the clearance at the tips of the blades in a turbine of an aeroengine. A system of that type generally operates by directing air against the outside surface of the turbine ring, which air is taken from a compressor and/or the fan of the engine, for example. Cool air delivered against the outside surface of the turbine ring has the effect of cooling it and thus of limiting its thermal expansion. Clearance is thus minimized. Conversely, hot air encourages thermal expansion of the turbine ring, thereby increasing the clearance and making it possible, for example, to avoid contact occurring at the above-mentioned pinch point.

Such active control is operated by a control unit, e.g. the full authority digital engine controller (FADEC) of the engine. Typically, the control unit acts on an adjustable-position valve in order to control the flow rate and/or the temperature of the air directed against the turbine ring, as a function of a clearance setpoint and of an estimate of the real clearance at the blade tips.

The use of an adjustable-position valve nevertheless presents drawbacks, in particular in terms of cost, of size, and of weight. In addition, controlling the valve requires it to be powered continuously.

OBJECT AND SUMMARY OF THE INVENTION

A main object of the present invention is thus to mitigate such drawbacks.

This object is achieved by a control unit for controlling clearance between the tips of blades of a turbine rotor in a gas turbine airplane engine and a turbine ring of a casing surrounding the blades, the control unit comprising a module for controlling a valve in order to act on a flow rate and/or a temperature of air directed against the casing, wherein said valve is a valve of the on/off type suitable for switching between an open state and a closed state in a determined reaction time, said control module comprising a corrector suitable for determining a first binary control signal capable of taking a first value corresponding to an open state of the valve and a second value corresponding to a closed state of the valve, said corrector including:

- a determination module for determining a correction magnitude as a function of a clearance setpoint and of an estimate of the clearance;
- a switch module suitable for determining a second binary control signal as a function of the correction magnitude, and
- a time-delay module suitable for determining a third binary control signal as a function of the second control signal, the duration between two successive changes of state of the third control signal being not less than the reaction time of the valve;

said first control signal being determined as a function of said third control signal.

The invention thus makes it possible to use an on/off type valve that is controlled by the first control signal. The use of such a valve is advantageous, in particular in terms of cost, size, reliability, and the power needed for controlling it. Furthermore, by determining the first control signal in accordance with the above-specified characteristics, it is possible for the valve to be opened or closed completely.

In an embodiment, the time-delay module is configured so that the duration between two successive changes of state in the third control signal is not less than a time-delay duration that is determined as a function of a flow rate setpoint.

This makes it possible to limit the switching frequency of the valve and thus to guarantee a good lifetime.

In an embodiment, said determination module comprises a proportional-integral corrector suitable for determining an initial correction magnitude as a function of a difference between the clearance setpoint and the estimate of the clearance, and a normalizer module suitable for determining said correction magnitude as a function of the initial correction magnitude and of a gain that depends on the estimate of the clearance.

The invention also provides an airplane engine including an on/off type valve and a control unit in accordance with the invention, wherein the valve is controlled as a function of the first control signal determined by the control unit.

The invention also provides a method of controlling clearance between the tips of blades of a turbine rotor in a gas turbine airplane engine and a turbine ring of a casing surrounding the blades, the method comprising controlling a valve in order to act on a flow rate and/or a temperature of air directed against the casing, wherein said valve is a valve of the on/off type suitable for switching between an open state and a closed state in a determined reaction time, the control of the valve comprising determining a first binary control signal capable of taking a first value corresponding to an open state of the valve and a second value corresponding to a closed state of the valve, the determination of the first control signal including:

- determining a correction magnitude as a function of a clearance setpoint and of an estimate of the clearance;
- determining a second binary control signal as a function of the correction magnitude; and
- determining a third binary control signal as a function of the second control signal, the duration between two successive changes of state of the third control signal being not less than the reaction time of the valve;

said first control signal being determined as a function of said third control signal.

The advantages and characteristics mentioned above with reference to the control unit apply in corresponding manner to the control method.

BRIEF DESCRIPTION OF THE DRAWINGS

Other characteristics and advantages of the present invention appear from the following description made with reference to the accompanying drawings that show an embodiment having no limiting character. In the figures.

DETAILED DESCRIPTION OF AN EMBODIMENT

Figure 1:
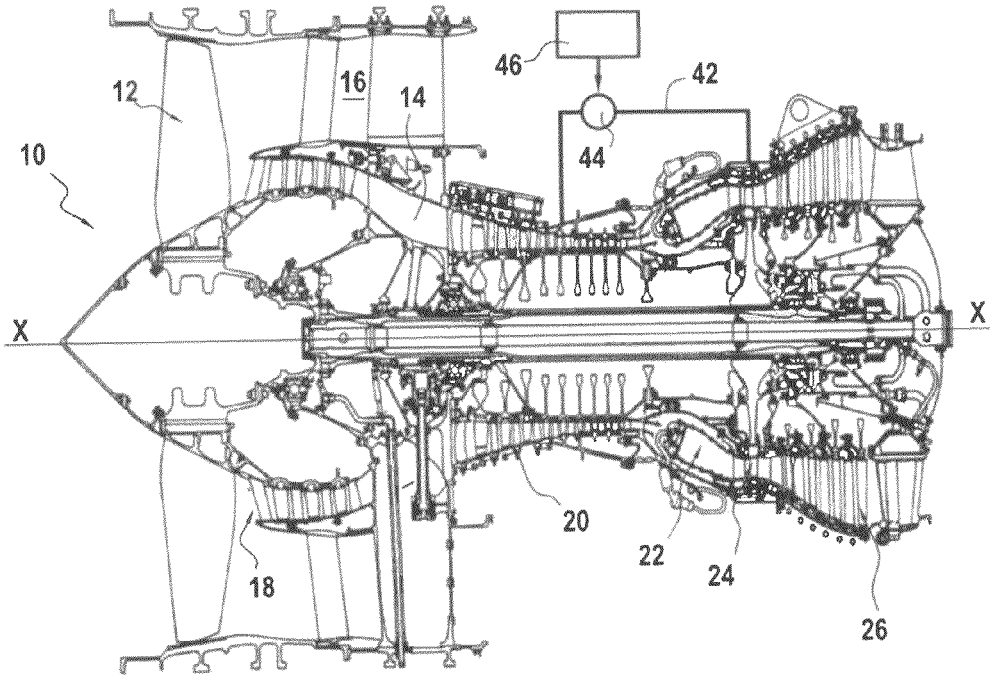
FIG. 1 is a diagrammatic view in longitudinal section of a portion of a gas turbine airplane engine in an embodiment of the invention.

FIG. 1 is a diagrammatic view of a turbojet 10 of the bypass and two-spool type to which the invention applies in particular. Naturally, the invention is not limited to this particular type of gas turbine airplane engine.

In well-known manner, the turbojet 10 of longitudinal axis X-X comprises in particular a fan 12 that delivers a stream of air into a primary stream flow passage 14 and a secondary stream flow passage 16 that is coaxial around the primary stream passage. From upstream to downstream in the flow direction of the gas stream passing therethrough, the primary stream flow passage 14 comprises a low pressure compressor 18, a high pressure compressor 20, a combustion chamber 22, a high pressure turbine 24, and a low pressure turbine 26.

Figure 2:
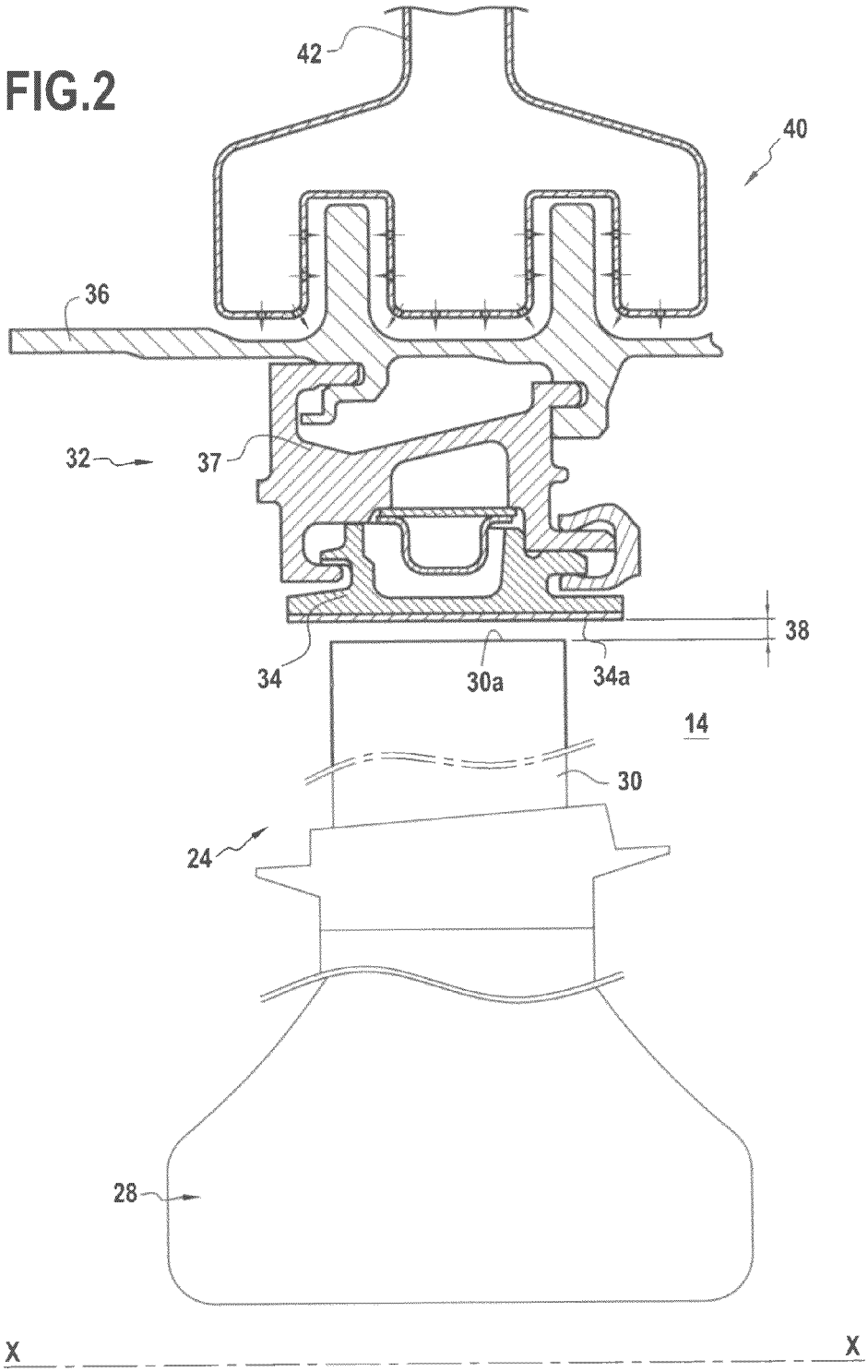
FIG. 2 is an enlarged view of the FIG. 1 engine showing in particular its high pressure turbine.

As shown more precisely in FIG. 2, the high pressure turbine 24 of the turbojet comprises a rotor made up of a disk 28 having a plurality of rotor blades 30 mounted thereon to extend into the primary stream flow passage 14. The rotor is surrounded by a turbine casing 32 comprising a turbine ring 34 carried by an outer turbine casing 36 via fastener spacers 37.

The turbine ring 34 may be made up of a plurality of adjacent segments or sectors. On the inside, it is provided with a layer 34*a* of abradable material and it surrounds the blades 30 of the rotor while leaving clearance 38 relative to the tips 30*a* thereof.

In accordance with the invention, a system is provided that enables the clearance 38 to be controlled by modifying the inside diameter of the outer turbine casing 36 in controlled manner. For this purpose, a control unit 46 controls the flow rate and/or the temperature of air that is directed against the outer turbine casing 36 as a function of an estimate of the clearance 38 and of a clearance setpoint. The control unit 46 is constituted, for example, by the FADEC of the turbojet 10.

In the example shown, a control housing 40 is arranged around the outer turbine casing 36. This housing receives cool air from an air duct 42 that has its upstream end opening out into the primary stream flow passage in one of the stages of the high pressure compressor 20 (e.g. via a conventional scoop that is not shown in the figures). The cool air flowing in the air duct is discharged against the outer turbine casing 36 (e.g. via multiple perforations in the wall of the control housing 40), thereby cooling it and thus reducing its inside diameter. As shown in FIG. 1, a valve 44 is arranged in the air duct 42. This valve 44 is controlled by the control unit 46.

Naturally, the invention is not limited to controlling the dimensions of the casing in this particular way. Thus, another example that is not shown consists in taking air from two different compressor stages and controlling valves 44 so as to modulate the flow rate from each of these stages in order to control the temperature of the mixture that is directed against the outer turbine casing 36.

In accordance with the invention, the valve 44 is a valve of the on/off type. The use of such a valve is advantageous, in particular in terms of cost, size, reliability, and the power needed to control it.

It can be understood that by controlling the valve 44 so as to act firstly on the frequency with which it is opened and secondly on the open/closed duty ratio of the valve, it is possible to vary the mean flow rate of the air directed against the casing.

Various on/off type valve architectures are well known to the person skilled in the art and are therefore not described herein. Preferably, an electrically controlled valve is selected that remains in the closed position in the absence of electrical power (this guarantees that the valve remains closed in the event of a control failure).

There follows a more detailed description of how the valve 44 is controlled by the control unit 46.

In known manner, the control unit 46 obtains, by measurement or by calculation, the values of various magnitudes that characterize the operation of the turbojet 10, and in particular:

- W25, the flow rate of air in the primary stream flow passage 14;
- T3, the outlet temperature from the high pressure compressor 20;
- T495, a temperature measured in the low pressure turbine 26; and
- Pamb, ambient pressure.

Figure 3:
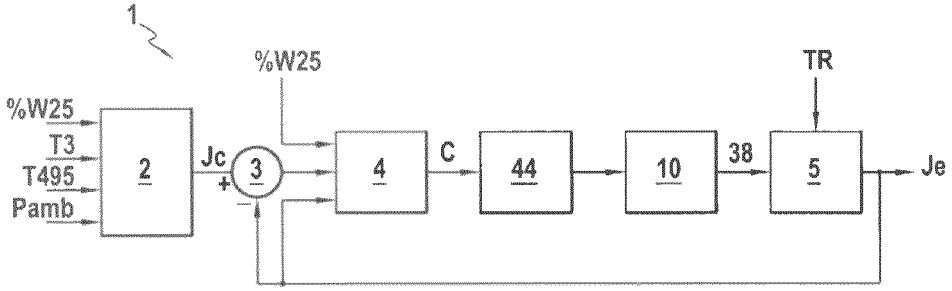
FIG. 3 shows a control loop implemented in the FIG. 1 engine.

The control unit 46 implements a regulation loop 1 shown in FIG. 3, in which a control signal C is determined for controlling the valve 44. The regulation loop 1 comprises a converter module 2, an adder 3, a corrector 4, the valve 44, the turbojet 10, and an estimator module 5.

The converter module 2, the adder 3, the corrector 4, and the estimator module 5 together form a control module for controlling the valve 44 that is integrated in the control unit 46. By way of example, this control module corresponds to a computer program that is executed by the control unit 46, to an electronic circuit of the control unit 46 (e.g. of the programmable logic circuit type), or to a combination of an electronic circuit and a computer program.

The converter module 2 determines a clearance setpoint, written Jc, as a function of a flow rate setpoint, expressed as a percentage of the flow rate W25 and written %W25. By way of example, the converter module 2 makes use of a correspondence table that depends on the values of T3, T495, and Pamb. The person skilled in the art knows how to make such a table and it is not described in detail herein.

The estimator module 5 determines an estimate of the clearance 38, written Je, as a function of a temperature state of the turbojet 10, as represented by a temperature TR. There is no sensor that measures directly the clearance 38, so it is necessary for it to be estimated for the regulation loop 1. The person skilled in the art knows how to determine a temperature TR that is representative of the temperature state of the turbojet 10 and how to determine the estimate Je of the clearance 38 as a function of the temperature TR, and those operations are not described in detail herein.

The adder 3 determines the difference c between Jc and Je.

The corrector 4 determines the control signal C as a function of the estimate Je, of the flow rate setpoint %W25, and of the difference c between Jc and Je. The control signal C is a binary signal that may take a first value corresponding to an open state of the valve 44 and a second value corresponding to a closed state of the valve 44. By convention, in this document, C=1 designates the open state of the valve 44 and C=0 designates the closed state of the valve 44.

The valve 44 presents a reaction time that is required for passing from the open state to the closed state. By way of example, this reaction time is of the order of 2 seconds.

Figure 4:
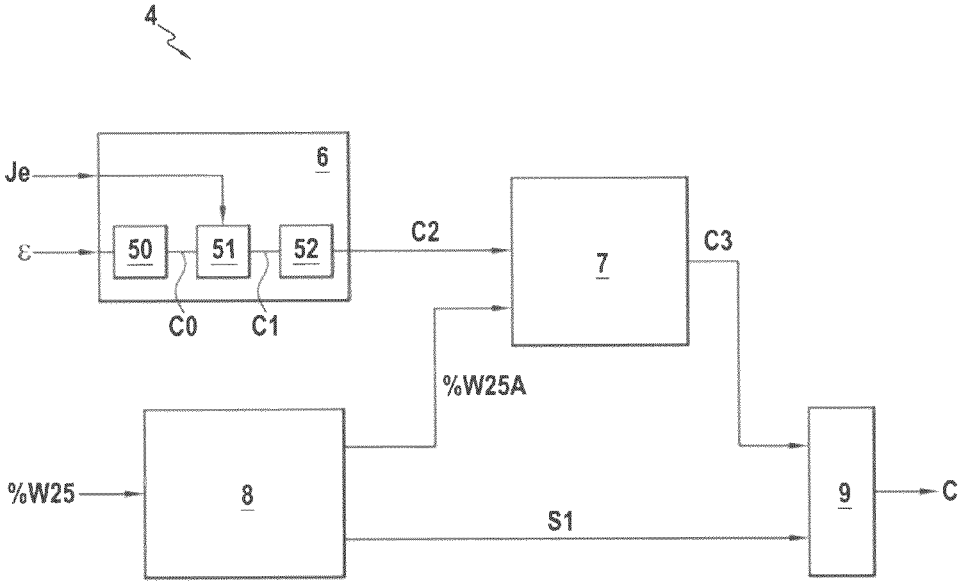
FIG. 4 shows in greater detail the corrector of the FIG. 3 control loop.

FIG. 4 shows the corrector 4 in greater detail.

The corrector 4 comprises a corrector module 6, a time-delay module 7, a test module 8, and a selector module 9.

The corrector module 6 comprises a proportional-integral corrector 50, a normalizer module 51, and a switch module 52.

The proportional-integral corrector 50 implements a transfer function of the proportional-integral type in order to determine a correction magnitude C0 as a function of the difference $\epsilon$. The normalizer module 51 multiplies the correction magnitude C0 by a gain G in order to provide a correction magnitude C1 of a value that lies in the range 0 to 1. The gain G depends on the estimate Je of the clearance 38, thus making it possible to take account of the variation in the gain of the regulation loop 1 as a function of the open or closed state of the valve 44.

Finally, the switch module 52 determines a binary control signal C2 as a function of the correction magnitude C1 and as a function of a predetermined threshold. For example, the switch module 52 may implement the following instructions:

If $C1 \leq 0.5$, then $C2=0$

If $C1 > 0.5$, then $C2=1$

The test module 8 performs tests on the flow rate setpoint %W25.

Firstly, the test module 8 tests whether the flow rate setpoint %W25 is greater than a predetermined threshold and it determines a capped flow rate setpoint, written %W25A, as a function of the result of the test. More precisely, the flow rate setpoint %W25A is capped at 1.1% of the flow rate W25, for example. Thus, if the test

%W25>1.1% W25 is true, then the test module 8 performs peak-limiting.

Furthermore, the test module 8 tests whether the flow rate setpoint %W25 is less than another predetermined threshold, and it determines a selection signal S1 as a function of the result of this test. The selection signal S1 is supplied to the selector module 9. By way of example, the test module 8 implements the following instructions:

If $\%W25 \leq 0.3\%W25$, then $S1=0$

If $\%W25 > 0.3\%W25$, then $S1=1$

The time-delay module 7 determines a binary control signal C3 as a function of the control signal C2 and of the flow rate setpoint %W25A, by implementing a time delay.

The inventors have found that the control signal C2 supplied by the above-described corrector module 6 may change value more quickly than the reaction time of the valve 44. Thus, the time-delay module 7 introduces a time delay to ensure that the valve 44 has the time to open or to close completely.

More precisely, in response to a change in the value of the control signal C2, the time-delay module 7 determines whether the duration that has elapsed since the most recent change of value is greater than a predetermined time-delay duration. If the time that has elapsed since the most recent change of value is longer than the predetermined time-delay duration, then the time-delay module 7 supplies a control signal C3 that is equal to the control signal C2. In contrast, if the duration that has elapsed since the most recent change of value is shorter than or equal to the predetermined time-delay duration, then the time-delay module 7 supplies a control signal C3 that is equal to the preceding value of the control signal C3.

The predetermined time-delay duration is a function of the capped flow rate setpoint %W25A supplied by the test module 8. More precisely, the time-delay duration is determined by a relationship associating the capped flow rate setpoint %W25A with a maximum switching frequency for the valve 44. Introducing a maximum switching frequency serves to limit the number of times the valve 44 switches. Limiting the number of times the valve switches serves to ensure that the valve 44 has a good lifetime, since it is known that the lifetime of a piece of equipment generally depends on the number of cycles it performs in operation.

The duration of the time delay given by the above-mentioned relationship is never less than the reaction time of the valve 44. Thus, the duration between two successive changes of state in the control signal C3 is not less than the reaction time of the valve 44.

Finally, the selector module 9 supplies the control signal C that is equal to the control signal C3 or that is equal to 0 (i.e. that corresponds to the valve 44 being in the closed state) as a function of the selection signal S1. More precisely, the selector module 9 implements the following instructions:

If S1=0, then C=0

If S1=1, then C=C3

In other words, the valve 44 is kept closed (C=0) if the flow rate setpoint %W25 is less than 0.3% W25. Otherwise, the valve 44 is opened or closed as a function of the control signal C3 as determined by the corrector module 6 and the time-delay module 7. Since the control signal C3 is determined as a function of a time delay that prevents any variation happening faster than the reaction time of the valve 44, the control signal C does not vary faster than the reaction time of the valve 44.

The inventors have simulated the operation of the regulation loop 1 for various types of mission of an aircraft. The simulation has served to verify firstly that the regulation loop 1 provides effective control over the clearance 38, and secondly that the number of times the valve 44 switches between the open and closed states is compatible with the number of changes of state that on/off type valves can typically perform.

What is claimed is:

1. A control unit for controlling clearance between the tips of blades of a turbine rotor in a gas turbine airplane engine and a turbine ring of a casing surrounding the blades, the control unit comprising a module for controlling a valve of the on/off type suitable for switching between an open state and a closed state in a determined reaction time in order to act on a flow rate and/or a temperature of air directed against the casing, wherein said control module comprises a corrector suitable for determining a first binary control signal capable of taking a first value corresponding to an open state of the valve and a second value corresponding to a closed state of the valve, said corrector including:

a determination module for determining a correction magnitude as a function of a clearance setpoint and of an estimate of the clearance;

a switch module suitable for determining a second binary control signal as a function of the correction magnitude, said switch module allocating to the second control signal:

said first value when the correction magnitude is greater than a predetermined threshold; and said second value when the correction magnitude is less than or equal to the predetermined threshold; and a time-delay module suitable for determining a third binary control signal as a function of the second control signal, said time-delay module allocating to the third control signal, in response to a change in the value of the second control signal:

the value of the second control signal when the duration that has elapsed since the most recent change in the value of the third control signal is longer than a predetermined time-delay duration; and the preceding value of the third control signal when the duration that has elapsed since the most recent change in the value of the third control signal is less than or equal to the predetermined time-delay duration;

the predetermined time-delay duration being not less than the reaction time of the valve;

said first control signal being determined as a function of said third control signal.

2. A control unit according to claim 1, wherein the time-delay duration is determined as a function of a flow rate setpoint.

3. A control unit according to claim 1, wherein said determination module comprises a proportional-integral corrector suitable for determining an initial correction magnitude as a function of a difference between the clearance setpoint and the estimate of the clearance, and a normalizer module suitable for determining said correction magnitude as a function of the initial correction magnitude and of a gain that depends on the estimate of the clearance.

4. An airplane engine including an on/off type valve and a control unit according to claim 1, wherein said valve is controlled as a function of the first control signal determined by the control unit.

5. A method of controlling clearance between the tips of blades of a turbine rotor in a gas turbine airplane engine and a turbine ring of a casing surrounding the blades, the method comprising controlling a valve of the on/off type suitable for switching between an open state and a closed state in a determined reaction time in order to act on a flow rate and/or a temperature of air directed against the casing, wherein the control of the valve comprises determining a first binary control signal capable of taking a first value corresponding to an open state of the valve and a second value corresponding to a closed state of the valve, the determination of the first control signal including:

determining a correction magnitude as a function of a clearance setpoint and of an estimate of the clearance;

determining a second binary control signal as a function of the correction magnitude by allocating to the second control signal:

said first value when the correction magnitude is greater than a predetermined threshold; and said second value when the correction magnitude is less than or equal to the predetermined threshold; and determining a third binary control signal as a function of the second control signal, by allocating to the third control signal, in response to a change of value in the second control signal:

the value of the second control signal when the duration that has elapsed since the most recent change in the value of the third control signal is longer than a predetermined time-delay duration and switching the valve between the open state or the closed state; and the preceding value of the third control signal when the duration that has elapsed since the most recent change in the value of the third control signal is less than or equal to the predetermined time-delay duration and not switching the valve between the open state or the closed state;

the duration of the predetermined time-delay being not less than the reaction time of the valve;

said first control signal being determined as a function of said third control signal.

* * * * *